US008344633B2

(12) United States Patent
Van Woudenberg et al.

(10) Patent No.: US 8,344,633 B2
(45) Date of Patent: Jan. 1, 2013

(54) DRIVING CIRCUIT FOR DRIVING A PLURALITY OF LIGHT SOURCES ARRANGED IN A SERIES CONFIGURATION

(75) Inventors: Roel Van Woudenberg, Eindhoven (NL); Petrus Johannes Bremer, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 303 days.

(21) Appl. No.: 12/602,682

(22) PCT Filed: Jun. 4, 2008

(86) PCT No.: PCT/IB2008/052180

§ 371 (c)(1),
(2), (4) Date: Dec. 2, 2009

(87) PCT Pub. No.: WO2008/149294

PCT Pub. Date: Dec. 11, 2008

(65) Prior Publication Data

US 2010/0181924 A1 Jul. 22, 2010

(30) Foreign Application Priority Data

Jun. 8, 2007 (EP) ..... 07109911

(51) Int. Cl.
*H05B 37/00* (2006.01)

(52) U.S. Cl. ..... 315/186; 315/291; 315/307; 315/312

(58) Field of Classification Search .... 315/169.1–169.4, 315/185 R, 186, 193, 209 R, 210, 215–217, 315/291, 307, 312, 361, 362; 345/77, 82, 84, 90, 95, 204, 208, 211–214
See application file for complete search history.

(56) References Cited

U.S. PATENT DOCUMENTS

| | | | | |
|---|---|---|---|---|
| 4,017,847 | A | 4/1977 | Burford et al. | |
| 6,153,980 | A | 11/2000 | Marshall et al. | |
| 7,009,580 | B2 * | 3/2006 | Leung | 345/46 |
| 7,646,154 | B2 * | 1/2010 | Kang et al. | 315/312 |
| 7,781,979 | B2 * | 8/2010 | Lys | 315/185 S |
| 2003/0117348 | A1 | 6/2003 | Knapp et al. | |
| 2005/0231459 | A1 * | 10/2005 | Furukawa | 345/102 |
| 2005/0243022 | A1 | 11/2005 | Negru | |

FOREIGN PATENT DOCUMENTS

| | | | |
|---|---|---|---|
| EP | 1589519 | A2 | 10/2005 |
| JP | 2006261160 | A | 9/2006 |

* cited by examiner

*Primary Examiner* — Jimmy Vu
(74) *Attorney, Agent, or Firm* — Mark L. Beloborodov

(57) ABSTRACT

A driving circuit (10) for driving a plurality of light sources (1) arranged in a series configuration (2) is described. A controllable current source (20) is connected to said series arrangement of light sources. Each light source (1(*i*)) is bridged by a corresponding controllable switch (25(*i*)). A controller (30) controls the operation of the current source (20) to set a current level and controls the operative states of the respective switches (25(*i*)) in order to individually control the light output of the corresponding light sources. The controller (30) is capable of individually setting the switch control signals (SL(O) for the respective switches (25(*i*)). Especially, the controller (30) is capable of boosting the light output of one selected light source (1(*x*)) while maintaining the light output of other light sources in the series arrangement (2). To this end, the current level is increased while the other light sources are dimmed.

15 Claims, 3 Drawing Sheets

DRIVING CIRCUIT FOR DRIVING A PLURALITY OF LIGHT SOURCES ARRANGED IN A SERIES CONFIGURATION

FIELD OF THE INVENTION

The present invention relates in general to a driving device for driving a plurality of light sources, specifically but not necessarily LEDs. The present invention further relates to a level shifter.

BACKGROUND OF THE INVENTION

There are situations where a lighting device comprises an array of light sources; an example is the backlight of an LCD display, for use as a monitor, a TV, or the like. In the following explanation it will be assumed that the light sources are LEDs, but this is not essential.

A 2D backlight LED array for an LCD comprises a plurality of horizontal strips arranged above each other, each strip comprising a plurality of LEDs arranged next to each other. The LEDs may be ON continuously, but typically the strips are switched ON and OFF with the frame frequency, such that the strip aligned with the image lines currently being displayed is ON while the other strips are OFF. The LEDs may all produce the same light output, but better display results, especially a better contrast ratio, can be achieved if the light output of the LEDs is amended in conformity with properties of the corresponding image portion. For instance, for a darker portion of the image the corresponding LEDs can be dimmed, whereas for a brighter portion of the image the corresponding LEDs can be boosted. Such adaptation may be performed for an entire horizontal strip (1D dimming), but preferably the adaptation is performed on the level of individual LEDs (2D dimming).

A complication in this respect is crosstalk between adjacent light sources, which problem is heavier in the case of LEDs as compared to HCFL lamps. Crosstalk generally means that a segment of the display is illuminated by two (or more) light sources. This will generally be the case for display segments located midway between two adjacent light sources, but, especially with LEDs having larger opening angle, this may also be the case for display segments that should be illuminated by one associated light source only. With crosstalk, it may be that adaptation of the light output of one light source results in an undesirable change of the light available for illumination of a display segment associated with an adjacent light source. Such undesirable change should be compensated by appropriately adapting the light output of such adjacent light source.

Thus, when one light source is dimmed, crosstalk compensation may require the adjacent light sources to be boosted, as will be explained with reference to FIG. 1, which schematically shows a front view of a portion of a lighting device for an LCD screen. Individual LEDs are indicated by reference numeral 1. The LEDs 1 are arranged next to each other with some mutual horizontal distance in horizontal strips, which are indicated by reference numeral 2 and which are arranged above each other with some vertical distance. Hereinafter, the horizontal direction will be taken as X-direction, while the vertical direction will be taken as Y-direction. Individual strips 2 will be distinguished by addition of a Y-index j. Individual LEDs in the j-th strip 2($j$) will be distinguished by addition of an X-index i and the Y-index j, as LED 1($i,j$). Although not essential, it will be assumed that i ranges from 1 to a maximum iM and that j ranges from 1 to a maximum jM.

In FIG. 1, a circle 3($i,j$) suggests a portion of the LCD screen illuminated by the LED 1($i,j$). It is noted that in practice such portion will not have a sharp borderline. In can be seen that LED 1($i,j$) produces an illumination contribution in screen segments corresponding to LEDs 1($i$−1,j), 1($i$+1,j), 1($i,j$−1), 1($i,j$+1). The illumination contribution in screen segments corresponding to LEDs 1($i$−1,j−1), 1($i$−1,j+1), 1(i+1, j−1), 1($i$+1,j+1) will be ignored here.

Assume that LED 1($i,j$) is to be dimmed. For compensating the crosstalk illustrated in FIG. 1, the LEDs 1($i$−1,j), 1($i$+1,j), 1($i,j$−1), 1($i,j$+1) should be boosted, while the remaining LEDs in strips 2($j$−1), 2($j$), 2($j$+1) should continue to be driven at normal light output.

SUMMARY OF THE INVENTION

The above requirements can be relatively easily complied with if the light sources are driven individually. However, a problem occurs if a plurality of the light sources are electrically connected in series, such as is the case for a strip 2 of LEDs. For instance, in strip 2($j$−1), LED 1($i,j$−1) should be boosted while all other LEDs in that strip should be unamended.

An object of the present invention is to overcome this problem. According to an important aspect of the present invention, a series arrangement of controllable light sources is supplied from a common controllable power source. A controller controls the power source as well as the individual light sources. If it is desired to boost one of the light sources, the output power of the power source is increased while the other individual light sources are dimmed.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1:
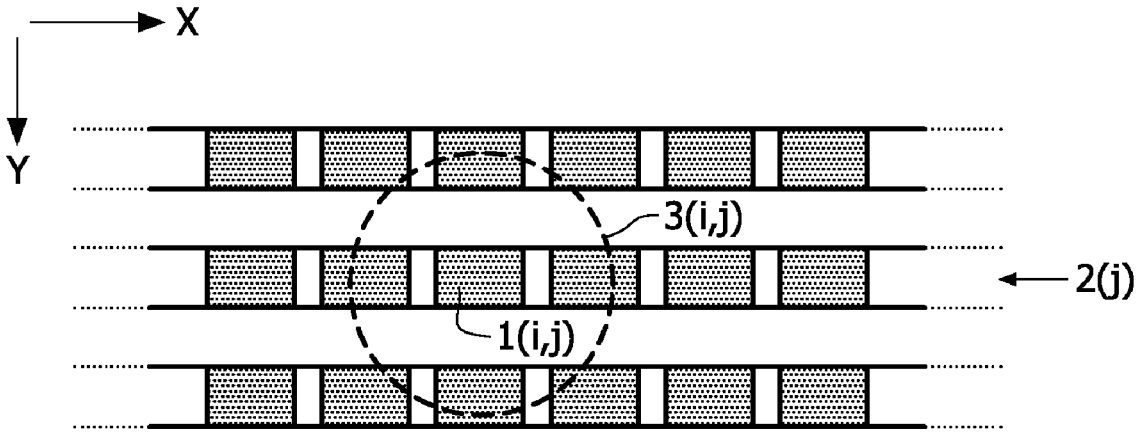
FIG. 1 schematically shows a front view of a portion of a lighting device for an LCD screen.
Figure 2:
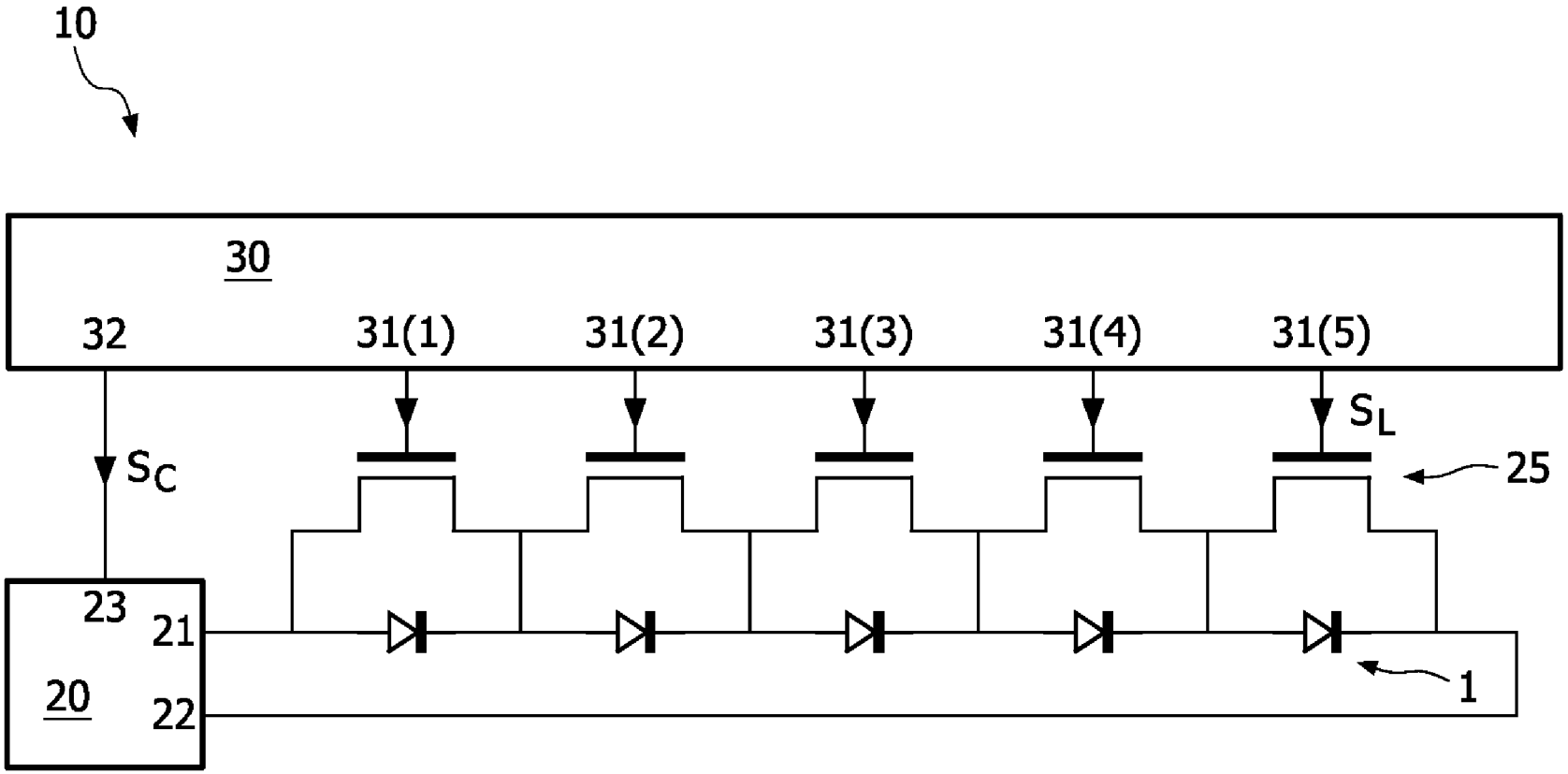
FIG. 2 is a block diagram schematically showing a driving circuit for driving a plurality of LEDs.

FIG. 2 schematically shows a driving circuit 10 for driving a plurality of LEDs 1. The LEDs are arranged in a series configuration, and are coupled to output terminals 21, 22 of a controllable current source 20. The figure shows only five LEDs 1, but the plurality of LEDs may comprise 2-4 or 6 or more LEDs. Together, the LEDs may form a strip 2 as discussed above. Each LED 1($i$) is bridged by a corresponding controllable switch 25($i$), preferably implemented as a transistor or a MOSFET. If a switch 25($i$) is closed (conductive), the corresponding LED 1($i$) is OFF.

The circuit 10 further comprises a controller 30, having output terminals 31($i$) coupled to respective control terminals of respective switches 25($i$), and having an output terminal 32 coupled to a control input 23 of the current source 20.

At its output terminal 32, the controller 30 generates a current control signal $S_C$ for controlling the operation of the current source 20 such as to set the light output of the LEDs 1.

In a first approximation, the light output (light intensity) L produced by an LED is linearly proportional to the current I in the LED according to $L(I)=k\cdot I$, k being a proportionality constant. If non-linearities are taken into account, the light output can be expressed as a function of the current I in the LED according to $L(i)=f(I)$. The current I produced by the current source 20 may be a constant current, and the current magnitude may be varied in order to vary the light output of the LEDs. It is also possible that the current I is modulated at a current frequency to be alternatively ON and OFF, in which case the duty cycle determines the average current and hence the average light output. If the duty cycle is represented by a factor $\alpha$ in the range from 0 to 1, the average current $I_{AV}$ can be expressed as $I_{AV}=\alpha\cdot I$, and the corresponding average light output $L_{AV}$ can be expressed as $L_{AV}=f(I_{AV})=f(\alpha\cdot I)$, which can be approximated as $\alpha\cdot f(I)$.

At its switch control outputs 31(*i*), the controller 30 generates respective switch control signals $S_L(i)$ for controlling the respective switches 25(*i*) in order to individually control the light output of the corresponding LEDs 1(*i*). Each switch control signal $S_L(i)$ is a pulse width modulation signal driving the corresponding switch 25(*i*) either to its conductive state or to its non-conductive state at a switching frequency, wherein the duty cycle of the switch control signal $S_L(i)$ determines a dim factor $\beta(i)$ in the range between 0 and 1: if the switch 25(*i*) is in its conductive state continuously, the corresponding LED 1(*i*) is OFF and the corresponding dim factor $\beta(i)$ is equal to 0, whereas if the switch 25(*i*) is in its non-conductive state continuously, the corresponding LED 1(*i*) is ON and the corresponding dim factor $\beta(i)$ is equal to 1.

If the current source 20 is controlled by duty cycle control, the switching frequency should be substantially higher than the current frequency. If the current source 20 produces a constant current, this limitation vanishes.

In normal operation, the lamp current (either as constant current magnitude, or as average current of a switched current) is set at a predefined nominal level $I_{NOM}$, while the dim factors $\beta(i)$ are all set to be equal to 1. Assume that it is desired to boost LED 1(*x*) by a factor $\xi>1$ while all other LEDs should maintain their light output. Increasing the corresponding dim factor $\beta(x)$ is not possible.

It is noted that this problem could be circumnavigated if, in normal operation, the dim factors $\beta(i)$ are all set to a value less than 1. However, this would imply that a portion of the installed light output capacity is normally not used. Since, generally, the costs of the LEDs increase with their light output capacity, it is desirable to have the installed light output capacity match the light output requirements in normal operation, and to have $\beta=1$.

According to the present invention, the controller 30 amends its current control signal $S_C$ for the current source 20 such that the lamp current level is increased by said factor $\xi$ to result in lamp current $I=\xi\cdot I_{NOM}$, while at the same time the controller 30 amends its switch control signals $S_L(i)$ for the respective switches 25(*i*) such that the dim factors $\beta(i)$ are all reduced by said factor $\xi$, except for the said dim factor $\beta(x)$. Thus, for all LEDs 1(*i*) with $i\neq x$, the (average) current will be equal to $\beta(i)\cdot I=(1/\xi)\cdot\xi\cdot I_{NOM}=I_{NOM}$, meaning that the light output for these LEDs will remain unaffected, while for LED 1(*x*) the (average) current will be equal to $\xi\cdot I_{NOM}$, meaning that the light output for this LED will be increased.

It is noted that non-linearities may be taken into account, which means that the lamp current level is increased by a factor $\xi$ to boost the LED 1(*x*) by a factor $\xi'$, such that $L(\xi\cdot I_{NOM})=\xi'\cdot L(I_{NOM})$.

It is noted that dimming of one or more LEDs in the series arrangement may simply be done by reducing the dim factor $\beta$ of that LED, without amendments of the current source and/or the dim factors of the remaining LEDs being necessary.

The above explains the principle of boosting one LED in a linear array without affecting the light output of the remaining LEDs in that array. It may be that boosting one LED in the array leads to crosstalk for the adjacent LEDs, which should be compensated by dimming the adjacent LEDs without affecting the light output of the remaining LEDs in that array. Assume that boosting one LED 1(*x*) by a factor $\xi$ should be compensated by dimming its neighboring LEDs 1(*x*−1) and 1(*x*+1) by a factor $\zeta>1$. In that case:

the lamp current level is increased by said factor $\xi$;

the dim factor $\beta(x)$ remains equal to 1;

the dim factors $\beta(x-1)$ and $\beta(x+1)$ are reduced by factor $\zeta\cdot\xi$;

the dim factors $\beta(i)$ are all reduced by said factor $\xi$, for $i\leqq x-1$ and $i\geqq x+1$.

Assume that one LED in the linear array should be dimmed by a factor $\delta>1$, which should be compensated by boosting the adjacent LEDs by a factor $\xi$ without affecting the light output of the remaining LEDs in that array. In that case:

the lamp current level is increased by said factor $\xi$;

the dim factor $\beta(x)$ is reduced by factor $\delta\cdot\xi$;

the dim factors $\beta(x-1)$ and $\beta(x+1)$ remain equal to 1;

the dim factors $\beta(i)$ are all reduced by said factor $\xi$, for $i\leqq x-1$ and $i\geqq x+1$.

In a further refinement, crosstalk to LEDs 1(*x*−2) and 1(*x*+2) may be compensated by slightly dimming these LEDs, as should now be clear to a person skilled in the art.

In the above, with reference to FIG. 2, the main aspects of the invention have been explained for an embodiment of only one linear array of LEDs. It should be clear to a person skilled in the art that the invention can also be implemented in a two-dimensional array having a plurality of one-dimensional arrays, wherein each one-dimensional array is provided with a corresponding current source. For each of such one-dimensional arrays, the above explanation applies, while further the crosstalk between adjacent one-dimensional arrays can be compensated by suitable boosting/dimming LEDs in the adjacent arrays.

It is noted that the orientation of the array is not an essential feature of the present invention. The invention can be implemented if the arrays are oriented vertically instead of horizontally, or have any other configuration. However, if crosstalk to adjacent linear arrays may be neglected, it is more advantageous if the linear arrays are oriented horizontally, because this allows the backlight controller to perform the dimming/boosting the LEDs in phase with the LCD refresh rate and allow this controller to perform the required calculations within a refresh period and in relation to a limited spatial region.

Special attention should be given to the control of the switches 25, because the voltage level needed to drive any switch depends on the ranking of that switch in the array and on the condition of the other switches in the same array. This is caused by the fact that the voltage drop over a transistor depends on its operative state. By way of non-limiting example, assume that the voltage drop over a power LED is about 2 V when it is carrying current (i.e. its associated switch is non-conductive) and is about 0.2 V when it is shorted by its associated switch. Assume that the lower voltage terminal 22 of current source 20 is at zero voltage level. Then, the cathode of the second LED (counting from the lower voltage terminal 22 of current source 20) is either at 2 V or at 0.2 V. In general, for the i-th LED, its cathode in this example is at $V_C(i)=2\cdot N_{ON}+0.2\cdot N_{OFF}$ V, $N_{ON}$ indicating the number of LEDs between the i-th LED and the lower voltage terminal 22 which are ON and $N_{OFF}$ indicating the number of LEDs between the i-th LED and the lower voltage terminal 22 which are OFF, with $N_{ON}$ $N_{OFF}$ i−1. Thus, in case the switches 25 are implemented as transistors or MOSFETs, the voltage level at the control terminal of switch 25(*i*) should be at $V_C$(i)+δ, with δ indicating the substantially constant voltage drop between control terminal and lower voltage terminal, for instance the base-emitter voltage of a saturated transistor.

On the other hand, the controller 30 typically comprises a digital circuit where the switch control signals are produced as logical signals with all logical "0"-signals at the same voltage level and all logical "1"-signals at the same voltage level.

To overcome this difficulty, the present invention proposes to use level shifters, as will be explained with reference to FIG. 3, which is a block diagram schematically illustrating a part of the controller 30 in more detail, and with reference to FIG. 4, which is a block diagram schematically illustrating an embodiment of a level shifter 50, implemented with discrete components.

Figure 3:
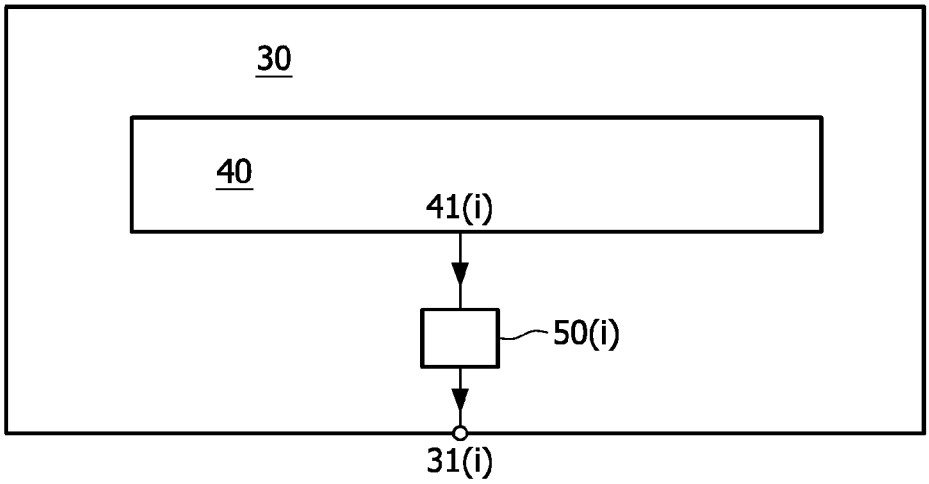
FIG. 3 is a block diagram schematically illustrating a part of a controller.

FIG. 3 illustrates that the controller 30 comprises a digital control circuit 40, having output terminals 41(*i*) corresponding to the output terminals 31(*i*) of the controller 30; for sake of simplicity, the figure only shows one such output terminal 41. The output terminals 41(*i*) carry logical output signals, either LOW (0 V) or HIGH, wherein the HIGH voltage level may depend on implementation and may for instance be equal to 5 V. Between output terminal 41(*i*) of the digital control circuit 40 and output terminal 31(*i*) of the controller 30, a level shifter 50(*i*) is arranged.

Figure 4:
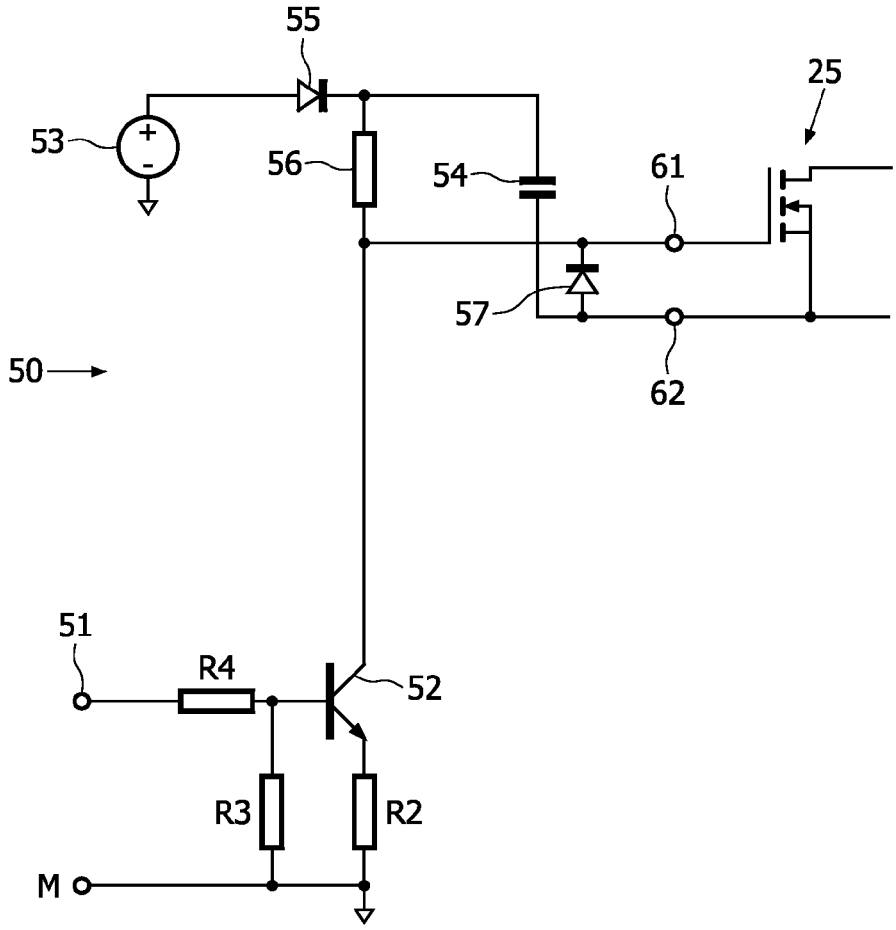
FIG. 4 is a block diagram schematically illustrating an embodiment of a level shifter.

FIG. 4 illustrates that a level shifter 50 has an input terminal 51 for connection with an output terminal 41 of the digital control circuit 40. A mass terminal M is connected to a mass terminal (not shown) of the digital control circuit 40. A transistor 52 has its emitter coupled to the mass terminal M through a resistor R2, has its base coupled to the mass terminal M through a resistor R3, and has its base coupled to the input terminal 51 through a resistor R4. If the input terminal 51 receives a HIGH input signal, transistor 52 is conducting; if the input terminal 51 receives a LOW input signal, transistor 52 is non-conducting.

The level shifter 50 has output terminals 61 and 62, connected to terminals of the switch 25.

The level shifter 50 further comprises a capacitor 54, having one terminal connected to output terminal 62 (for connection to the source terminal of the MOSFET 25), and having its other terminal connected to the cathode of a diode 55, whose anode is connected to the positive output terminal of an auxiliary voltage source 53 providing a suitable voltage, for instance 5 V. It is noted that the negative output terminal of the auxiliary voltage source 53 is connected to the mass terminal 52 of the level shifter 50. The node between capacitor 54 and diode 55 is coupled to output terminal 61 (for connection to the control terminal of the MOSFET 25) via a resistor 56.

It is noted that each level shifter 50(*i*) may have its own individual auxiliary voltage source 53(*i*), but it is also possible that all level shifters share a common auxiliary voltage source.

The level shifter 50 further comprises a diode 57, whose cathode is connected to output terminal 61 and to the collector of transistor 52, and whose anode is connected to output terminal 62.

At regular intervals, for instance once at the beginning if every frame period, capacitor 54 is briefly charged to the voltage of the auxiliary voltage source 53 (+5 V), as will be explained later. The charging time is sufficiently short such as to be negligible compared to a frame period. For the remainder of the frame period, capacitor 54 functions as power source for driving switch 25.

If the transistor 52 is non-conducting, the capacitor voltage is applied to the gate of the MOSFET 25 via resistor 56. Thus, the MOSFET 25 is conductive.

If the transistor 52 is conducting, transistor 52 draws current from output terminal 62 via diode 57. Thus, MOSFET 25 is driven by the voltage drop over diode 57 in its conductive state, in other words the gate of the MOSFET 25 is at about 0.6 V lower level than its source terminal, so the MOSFET is non-conductive and its drain terminal is floating.

Charging of the capacitor 54 can be done relatively easily by sending LOW control signals to all input terminals 51 of all level shifters simultaneously. It can easily be shown that, as a result, all switches 25 are conductive and the voltage drop over each switch 25 is very small. Consequently, in each level shifter 50, the voltage level at output terminal 62 is close to zero, and a current can flow from the voltage source 53 via diode 55 towards output terminal 62, charging capacitor 54.

Summarizing, the present invention provides a driving circuit (10) for driving a plurality of light sources (1) arranged in a series configuration (2). A controllable current source (20) is connected to said series arrangement of light sources. Each light source (1(*i*)) is bridged by a corresponding controllable switch (25(*i*)). A controller (30) controls the operation of the current source (20) to set a current level and controls the operative states of the respective switches (25(*i*)) in order to individually control the light output of the corresponding light sources. The controller (30) is capable of boosting the light output of one selected light source (1(*x*)) while maintaining the light output of other light sources in the series arrangement (2). To this end, the current level is increased while the other light sources are dimmed.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims.

For instance, although the above explanation describes boosting of one LED in a string, it is possible to boost two or more of such LEDs, if desired. Boosting may be done to the same level, but this is not necessary, because higher current level may be combined with an individual dimming factor to produce an individual boosting factor.

Further, other implementations for the interface between the digital control circuit 40 and the switches 25 are also possible. By way of example, the switches 25 may be implemented as optocouplers.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. A driving circuit for driving a plurality of light sources arranged in a series configuration, the circuit comprising:

a controllable current source having output terminals, the series arrangement of light sources being connected to said output terminals;

a plurality of controllable switches, each light source being bridged by a corresponding controllable switch;

a controller, having switch control output terminals coupled to respective control terminals of respective switches, and having a current control output terminal coupled to a control input of the current source, the controller being configured for generating at current control output terminal a current control signal ($S_C$) for controlling the operation of the current source, and the controller further being configured for generating at switch control output terminals respective switch control signals ($S_L(i)$) for controlling the operative states of the respective switches in order to individually control the light output of the corresponding light sources;

wherein the controller is capable of individually setting the switch control signals ($S_L(i)$) for the respective switches, and wherein the controller is configured to boost the light output of one selected light source while maintaining the light output of other light sources in the series arrangement.

2. The driving circuit according to claim 1, wherein the controller is configured for generating current control signal ($S_C$) so as to define an average light source current.

3. The driving circuit according to claim 2, wherein the current produced by the current source is a constant current, and wherein the current source is responsive to the current control signal ($S_C$) so as to vary the current magnitude.

4. The driving circuit according to claim 2, wherein the current produced by the current source is pulse width modulated at a current frequency to be alternatively ON and OFF, and wherein the current source is responsive to the current control signal ($S_C$) so as to vary the duty cycle of the current.

5. The driving circuit according to claim 1, wherein the controller is configured for generating switch control signals ($S_L(i)$) as pulse width modulation signals driving the corresponding switches either to conductive states or to non-conductive states at a switching frequency, wherein the duty cycle of the switch control signal ($S_L(i)$) determines a light source dim factor ($\beta(i)$) in the range between 0 and 1.

6. A lighting device comprising a plurality of light sources arranged in a series arrangement and a driving circuit according to claim 1.

7. A driving circuit for driving a plurality of light sources arranged in a series configuration, the circuit comprising:

a controllable current source having output terminals, the series arrangement of light sources being connected to said output terminals;

a plurality of controllable switches, each light source being bridged by a corresponding controllable switch;

a controller, having switch control output terminals coupled to respective control terminals of respective switches, and having a current control output terminal coupled to a control input of the current source, the controller being configured for generating at current control output terminal a current control signal ($S_C$) for controlling the operation of the current source, and the controller further being configured for generating at switch control output terminals respective switch control signals ($S_L(i)$) for controlling the operative states of the respective switches in order to individually control the light output of the corresponding light sources;

wherein the controller is capable of individually setting the switch control signals ($S_L(i)$) for the respective switches, and wherein the controller is configured to boost the light output of one selected light source while maintaining the light output of other light sources in the series arrangement, and to provide current control signal ($S_C$) so as to increase an average light source current ($I_{AV}$) by a boost factor ($\xi$) higher than 1, and to provide switch control signals ($S_L(i)$) for said other light sources such that the dim factors ($\beta(i)$) for said other light sources are reduced.

8. The driving circuit according to claim 7, wherein the dim factors ($\beta(i)$) for said other light sources are reduced by the boost factor ($\epsilon$).

9. A driving circuit for driving a plurality of light sources arranged in a series configuration, the circuit comprising:

a controllable current source having output terminals, the series arrangement of light sources being connected to said output terminals;

a plurality of controllable switches, each light source being bridged by a corresponding controllable switch;

a controller, having switch control output terminals coupled to respective control terminals of respective switches, and having a current control output terminal coupled to a control input of the current source, the controller being configured for generating at current control output terminal a current control signal ($S_C$) for controlling the operation of the current source, and the controller further being configured for generating at switch control output terminals respective switch control signals ($S_L(i)$) for controlling the operative states of the respective switches in order to individually control the light output of the corresponding light sources;

wherein the controller is capable of individually setting the switch control signals ($S_L(i)$) for the respective switches, wherein the controller is configured to boost the light output of one selected light source while maintaining the light output of other light sources in the series arrangement, and wherein the controller is configured to provide switch control signals ($S_L(i)$) for at least one light source neighboring said one selected light source such that the light output of said at least one neighboring light source is reduced for crosstalk compensation.

10. The driving circuit according to claim 9, wherein the dim factor ($\beta(x-1; \beta(x+1)$) for said at least one neighboring light source is reduced by a factor higher than a boost factor ($\xi$).

11. A driving circuit for driving a plurality of light sources arranged in a series configuration, the circuit comprising:

a controllable current source having output terminals, the series arrangement of light sources being connected to said output terminals;

a plurality of controllable switches, each light source being bridged by a corresponding controllable switch;

a controller, having switch control output terminals coupled to respective control terminals of respective switches, and having a current control output terminal coupled to a control input of the current source, the controller being configured for generating at current control output terminal a current control signal ($S_C$) for controlling the operation of the current source, and the controller further being configured for generating at switch control output terminals respective switch control signals ($S_L(i)$) for controlling the operative states of the respective switches in order to individually control the light output of the corresponding light sources;

wherein the controller is capable of individually setting the switch control signals ($S_L(i)$) for the respective switches, and wherein the controller is configured to dim the light output of one selected light source, and to boost at least one light source neighboring said one selected light source for crosstalk compensation, while maintaining the light output of other light sources in the series arrangement.

12. A driving circuit for driving a plurality of light sources arranged in a series configuration, the circuit comprising:

a controllable current source having output terminals, the series arrangement of light sources being connected to said output terminals;

a plurality of controllable switches, each light source being bridged by a corresponding controllable switch;

a controller, having switch control output terminals coupled to respective control terminals of respective switches, and having a current control output terminal coupled to a control input of the current source, the controller being configured for generating at current control output terminal a current control signal ($S_C$) for controlling the operation of the current source, and the controller further being configured for generating at switch control output terminals respective switch control signals ($S_L(i)$) for controlling the operative states of the respective switches in order to individually control the light output of the corresponding light sources;

wherein the controller is capable of individually setting the switch control signals ($S_L(i)$) for the respective switches, and wherein the controller is configured to determine a required light output for all light sources, to determine which one of said light sources is to produce the highest light output, to set switch control signal ($S_L(x)$) for this light source such that a dim factor ($\beta(x)$) equal to 1 is defined, to set current control signal ($S_C$) such that an average light source current ($I_{AV}$) is produced resulting in the required highest light output for this light source with dim factor ($\beta$) equal to 1, and to set switch control signals ($S_L(i \neq x)$) for the other light sources such that corresponding dim factors ($\beta(i \neq x)$) are defined resulting, in combination with said average light source current ($I_{AV}$), in the required corresponding light outputs.

13. A driving circuit for driving a plurality of light sources arranged in a series configuration, the circuit comprising:

a controllable current source having output terminals, the series arrangement of light sources being connected to said output terminals;

a plurality of controllable switches, each light source being bridged by a corresponding controllable switch;

a controller, having switch control output terminals coupled to respective control terminals of respective switches, and having a current control output terminal coupled to a control input of the current source, the controller being configured for generating at current control output terminal a current control signal ($S_C$) for controlling the operation of the current source, and the controller further being configured for generating at switch control output terminals respective switch control signals ($S_L(i)$) for controlling the operative states of the respective switches in order to individually control the light output of the corresponding light sources;

wherein the controller is capable of individually setting the switch control signals ($S_L(i)$) for the respective switches, and said driving circuit further configured for driving an array comprising a plurality of series arrangements of light sources each being bridged by a corresponding controllable switch, the series arrangements being arranged adjacent to each other, the driving circuit comprising individual controllable current sources for powering respective individual series arrangements, wherein the controller is configured for generating current control signal ($S_C(j)$) for controlling the operation of the respective current sources, and wherein the controller is configured for generating switch control signals ($S_L(i,j)$) for controlling the operative states of the respective switches.

14. The driving circuit according to claim 13, wherein the controller is configured to boost the light output of one selected light source in a specific series arrangement, and to adapt switch control signals ($S_L(i,j-1)$; $S_L(i,j+1)$) for at least one neighboring light source in a neighboring series arrangement such that the dim factor ($\beta(i,j-1)$; $\beta(i,j+1)$) for said at least one neighboring light source is reduced for crosstalk compensation.

15. The driving circuit according to claim 13, wherein the controller is configured to dim the light output of one selected light source in a specific series arrangement, and to boost the light output of at least one neighboring light source in a neighboring series arrangement for crosstalk compensation.

* * * * *